US008406441B2

(12) United States Patent
Ruwisch

(10) Patent No.: US 8,406,441 B2
(45) Date of Patent: Mar. 26, 2013

(54) USER-ADAPTABLE HEARING AID COMPRISING AN INITIALIZATION MODULE

(76) Inventor: Dietmar Ruwisch, Berlin (DE)

( * ) Notice: Subject to any disclaimer, the term of this patent is extended or adjusted under 35 U.S.C. 154(b) by 702 days.

(21) Appl. No.: 12/669,249

(22) PCT Filed: Jul. 17, 2008

(86) PCT No.: PCT/EP2008/059415
§ 371 (c)(1),
(2), (4) Date: Jan. 15, 2010

(87) PCT Pub. No.: WO2009/010572
PCT Pub. Date: Jan. 22, 2009

(65) Prior Publication Data

US 2010/0183177 A1 Jul. 22, 2010

(30) Foreign Application Priority Data

Jul. 18, 2007 (DE) ..... 10 2007 033 484

(51) Int. Cl.
*H04R 25/00* (2006.01)

(52) U.S. Cl. ..... 381/317; 381/312; 381/318

(58) Field of Classification Search ..... 381/60, 381/312, 314, 317, 318, 320, 321, 71.1, 71.11, 381/71.12, 72, 73.1, 83, 93, 94.1, 94.2
See application file for complete search history.

(56) References Cited

U.S. PATENT DOCUMENTS

| | | | | |
|---|---|---|---|---|
| 4,425,481 | A * | 1/1984 | Mansgold et al. | 381/317 |
| 5,259,033 | A * | 11/1993 | Goodings et al. | 381/318 |
| 7,574,012 | B2 * | 8/2009 | Eggers et al. | 381/317 |

FOREIGN PATENT DOCUMENTS

| | | | |
|---|---|---|---|
| EP | 1542500 | A3 | 6/2005 |
| EP | 1713302 | A1 | 10/2006 |
| WO | 9603848 | A1 | 2/1996 |
| WO | 9714267 | A1 | 4/1997 |

OTHER PUBLICATIONS

Yan Yan; Communication Invention Examination Department—State Intellectual Property Office of P.R.C.; Search Report for Serial No. 200880025072.4, filed Jul. 17, 2008; Ruwisch, Dietmar.

* cited by examiner

*Primary Examiner* — Huyen D Le
(74) *Attorney, Agent, or Firm* — William Greener; Bond, Schoeneck & King, PLLC

(57) ABSTRACT

The invention relates to a hearing aid to be arranged at and/or in an ear, comprising a microphone for converting acoustic signals into electrical signals, a hearing module for providing the electrical signals, a loudspeaker for converting the electrical signals outputted from the hearing module into acoustic signals. The hearing module comprises a means for noise suppression effecting a noise estimation to determine a signal-dependent filter and to provide a noise-reduced output signal.

20 Claims, 5 Drawing Sheets

USER-ADAPTABLE HEARING AID COMPRISING AN INITIALIZATION MODULE

Figure 1:
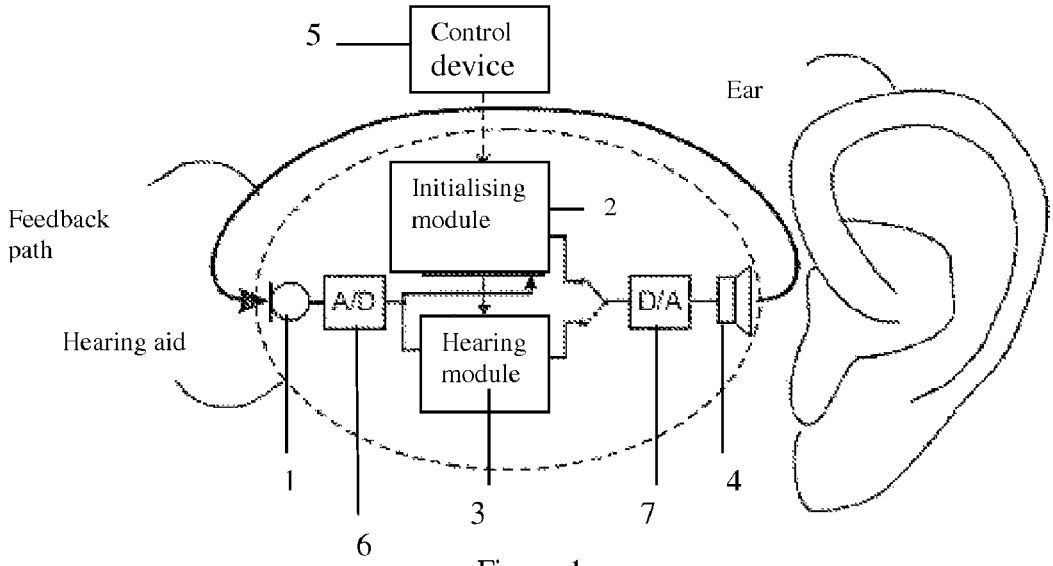

The invention relates to a hearing aid, in particular to a medical hearing aid, comprising a means for compensating for noises. Preferably, the hearing aid compensates for amblyacousia. The invention further relates to a corresponding method for operating and adjusting a hearing aid according to the invention.

The medical demand for hearing aids is high and increases constantly and the available devices cover a broad range from simple broadband amplifiers to be worn behind the ear to highly-developed and considerably miniaturised devices fitting into the auditory canal of the user.

An essential quality feature of hearing aids of any miniaturising level is the adaptability of the amplification factor and the frequency response of the internal amplifiers to the individual hearing defect of the user. In practice, there are a lot of different types of hearing defects (apart from complete deafness, which, however, cannot be corrected with the hearing aids described herein) so that a corresponding adaptability of the hearing aid is required for the correction of a defective hearing. If this adaptation is omitted and sound is only uniformly amplified in the entire processible frequency range, it leads to the fact that sounds in frequency regions in which the user still hears well are amplified too much and, in the worst case, the hearing is even further damaged. However, in the frequency regions concerned, in which a greater amplification would be necessary, the broadband amplification is usually too low considering the undamaged ranges of the spectra.

The adjustment of the amplification of a hearing aid according to the prior art is performed by a hearing aid audiologist on the basis of an audiogram, which was ascertained from the patient before-hand by himself or an otorhinolaryngologist. To this end various sounds are played to the patient by means of calibrated earphones with increasing loudness, wherein the patient is to indicate from which loudness on a sound is audible. Thus, the individual frequency response, in particular the lower auditory threshold of the patient's hearing is ascertained at various frequencies. The more different frequencies are used, the higher is the spectral resolution of the audiogram; and the more often the measurement with the same sound is repeated, the higher is the statistical confidence level for this measurement value. The thus ascertained audiogram informs about the regions of the auditory spectrum in which an amplification is necessary for the patient; and the hearing aid audiologist then accordingly adjusts the amplification of the hearing aid for different spectral regions. Subsequently, an audiogram with the hearing aid should be recorded for controlling purposes to keep records of its purpose and to check its adjustment. In the ideal case, this new audiogram corresponds to that of an average normal hearing. This ideal, however, is rarely achieved since the adjustments of an acoustician are usually not precise enough and most hearing aids do not allow for a sufficiently high enough adjustment of the frequency response of the amplification. Most of the devices used have only three regions to be adjusted separately for high, middle and low frequencies, wherein the hearing aid audiologist is forced to accept considerable compromises in his work.

Besides the compensation of the auditory curve of the patient, the "pain threshold" of the patient has to be taken into consideration upon adjustment of the hearing aid. Even an amplification which is perfectly adapted to the hearing defect of the patient but linear would lead to the fact that the patient can hear talk in a low voice, however, loud sounds are amplified to such a great extent that painful or even harmful loudness is the result. This is in particular relevant when the loudness regarded as painful is lowered due to the illness of the hearing. The prior art usually solves this problem in that the maximum output loudness of a hearing aid is limited due to its design. The maximum loudness is limited by nature due to the small size and the limited electrical energy. Moreover, even the simplest devices usually have a volume control with which the user can adapt the volume of its hearing aid, e.g., to different environmental situations. High-quality hearing aids automatically perform such an adjustment dependent on the situation and do not only alter the volume but also optimise the individual frequency response with regard to the specific situation (e.g., talk, music, street noise). However, such an adaptation dependent on the situation, be it automatically or manually, goes beyond the medical aspect of the re-establishment of a normal hearing.

The decisive data for the analytical characterisation of a hearing defect are given by means of the audiogram and the loudness pain threshold. The data about syllable articulation (e.g., Freiburg word test) often additionally acquired by the otorhinolaryngologist or the hearing aid audiologist during an audiometry are prior art but may well be considered to be superfluous with regard to the possibilities and limits of a hearing aid.

A further technical problem which is independent of the hearing defect of the patient arises in that there is—in particular in highly-integrated devices—only a limited spatial distance between sound recording (microphone) and sound generation (miniature loudspeaker, often called "transducer" in the hearing aid, in the following always simply called "loudspeaker"). Thus, there is the risk that for individual frequencies the closed-loop gain between loudspeaker and microphone is greater than 1 thus leading to acoustic feedback howling. This problem is often solved in that critical frequencies are dampened with additional narrow-band filters ("notch filter"). Thus, the acoustic feedback or the tendency to oscillate of the system can be suppressed, however, these additional filters influence the frequency response in an undesired manner, in particular they possibly thwart the actually required high amplification in the regions of the spectrum in which the patient hears badly.

Regarding hearing aids of the highest price range, the prior art discloses further methods of the digital signal processing going beyond the described methods. Thus, one tries, e.g., to make a difference between voice and noise components in the sound signal in order to remove the latter or at least to reduce it. However, in such methods of noise suppression also known from other fields of application, various side effects have to be taken into account. In some methods, e.g., the damping of the noise also entails an alienation of the useful sound, e.g., of the language, and the sound of the dampened noises is considerably changed. Furthermore, some methods cause a signal delay, which can be accepted to a very limited extent only in a hearing aid since otherwise the things seen and heard are no longer chronologically synchronous, which may lead to distortions of perception of the user of the hearing aid.

The object of the invention is to provide an improved hearing aid which overcomes the above-mentioned disadvantages. In particular, a hearing aid is to be provided with an improved noise suppression and which is preferably adjustable in interaction with the user. Further a corresponding method is to be provided.

The object is achieved with the features of the claims.

According to the invention, parameters of an adjustable filter are modified such by means of a noise estimation that a noise suppression can be effected which leads to a real acoustic perceptual image for the user of a hearing aid. To this end, damping factors can be ascertained, e.g., at certain time intervals or continuously. The parameters of an optional hearing defect compensation and a noise suppression can be combined such that the signal to be processed is adapted in one calculation step per frequency band or discrete frequency.

According to an embodiment of the invention, in interaction with the user, an audiogram, i.e., the spectral characteristics of the hearing ability of the user is to be ascertained automatically during an initialising phase and the internal signal processing, preferably a digital signal processing, such as, e.g., multiband equalizer as well as limiter/compressor, is to be adapted with the obtained data such that an ideal compensation of the individual hearing defect is achieved. The ascertained data, i.e., correction factors for compensating the hearing defect are stored, preferably in a non-volatile storing medium. Preferably the user may conduct the ascertainment of an audiogram any time again or optimise existing data. The correction factors may be already fixed or predetermined, e.g., by a physician or hearing aid audiologist as starting basis for an adjustment of the audiogram by the user.

The audiometry, i.e., the ascertainment of the audiogram of a patient, may take place in the hearing aid itself. Thus, it is rendered possible that the hearing aid automatically adjusts the frequency response of its amplification in a closed system and no audiogram is interpreted by a hearing aid audiologist. Thus, the individual hearing defect of a patient can be exactly compensated for since the parameters of the internal signal processing are determined by the hearing aid itself in an initialising mode, which is different from the mode of operation in which the parameters are used. The hearing aid emits test signals in the initialising mode; signals recorded by the own microphone are preferably at least partially not supplied to the sound emission of the hearing aid. No calibrated measurement devices as necessary for a classical audiometry are required; a previous calibration of the hearing aid as such is not necessary either and the influence of the physical presence of the hearing aid in the auditory canal on the hearing is intrinsically taken into account.

Figure 2:
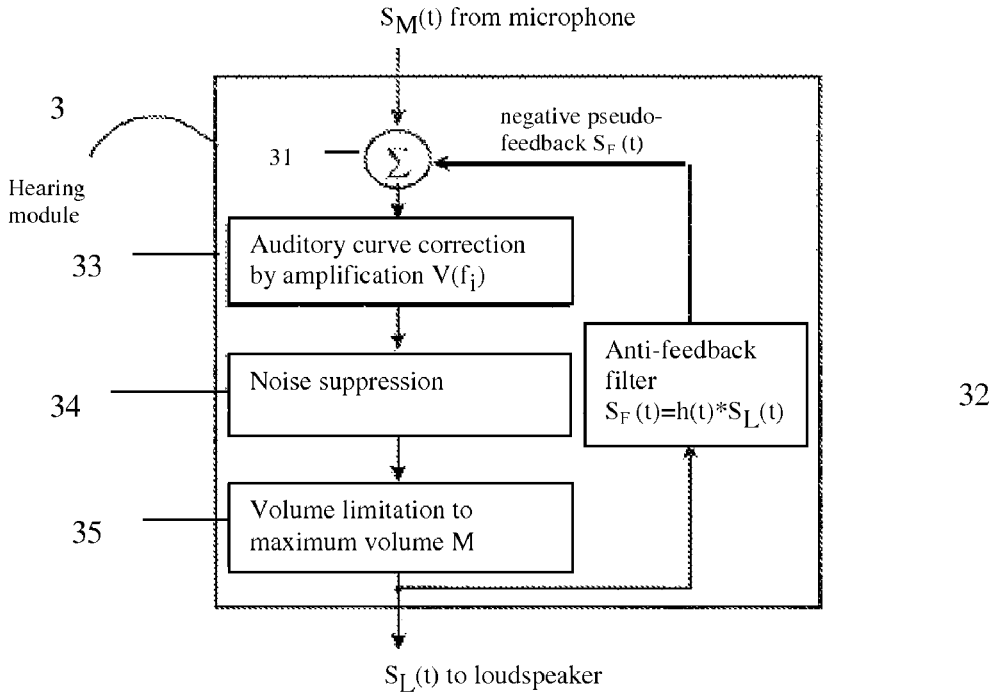
Figure 3:
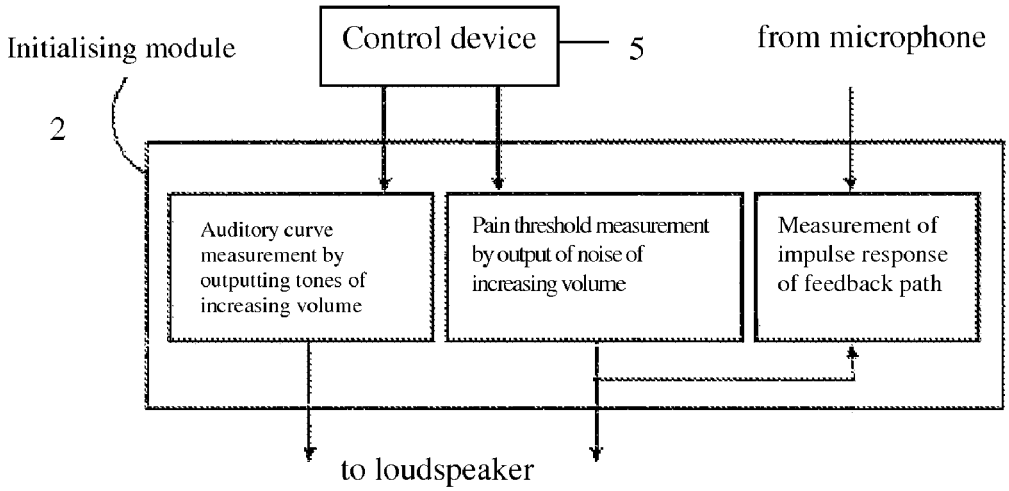
Figure 4:
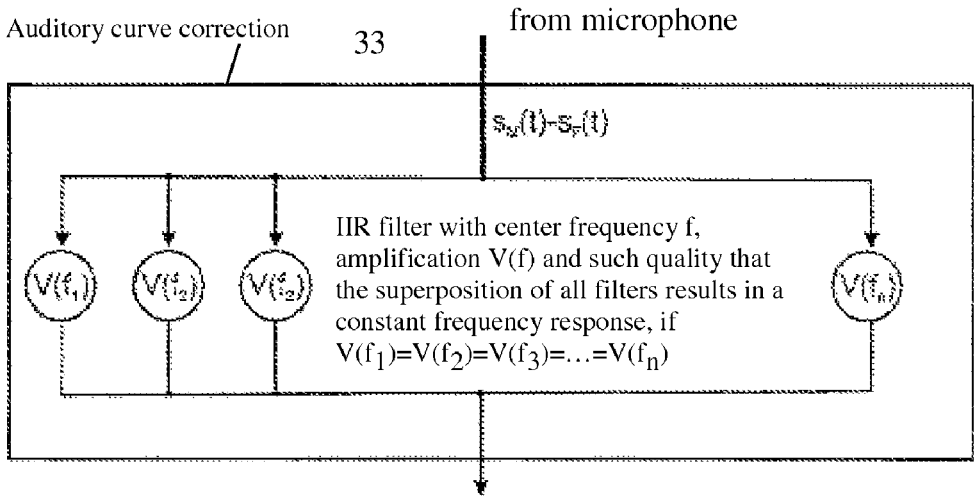
Figure 5A:
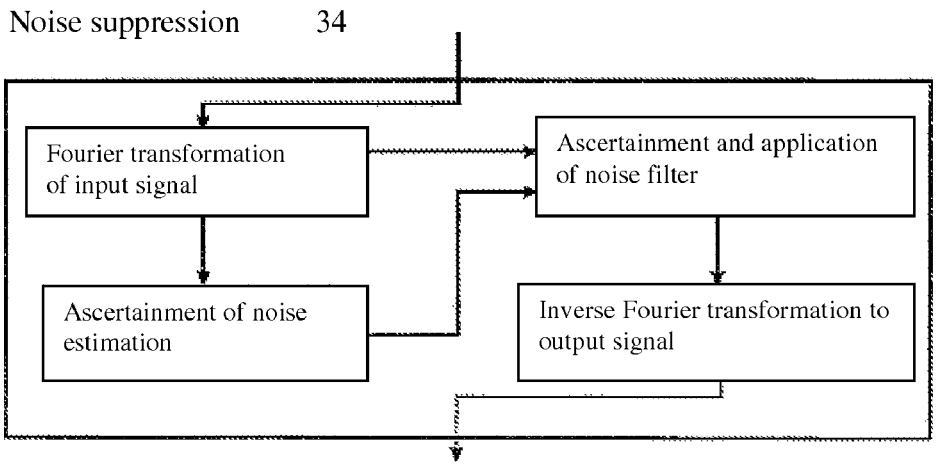
Figure 5B:
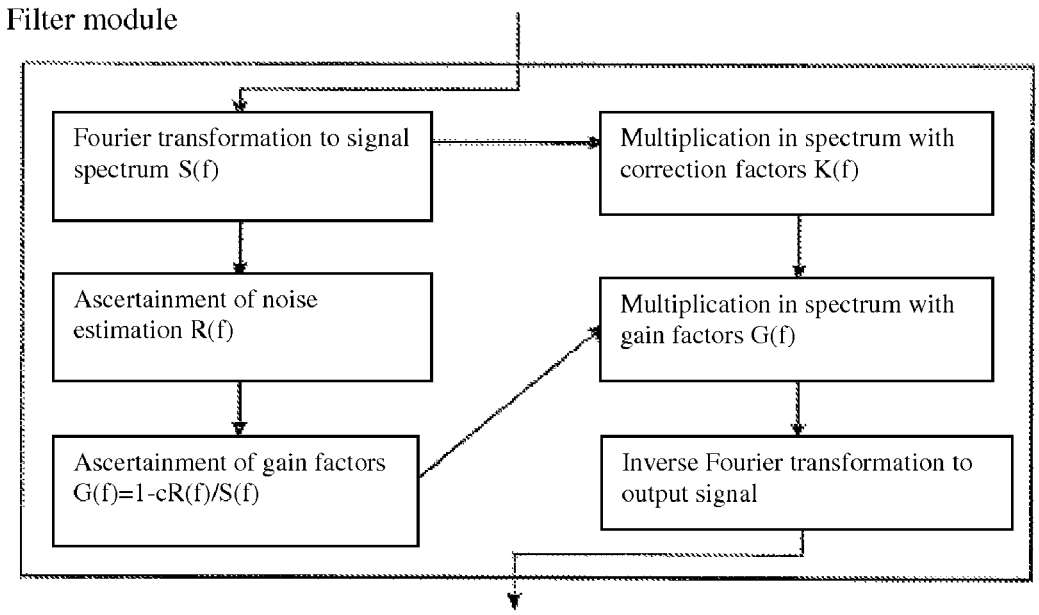
Figure 6:
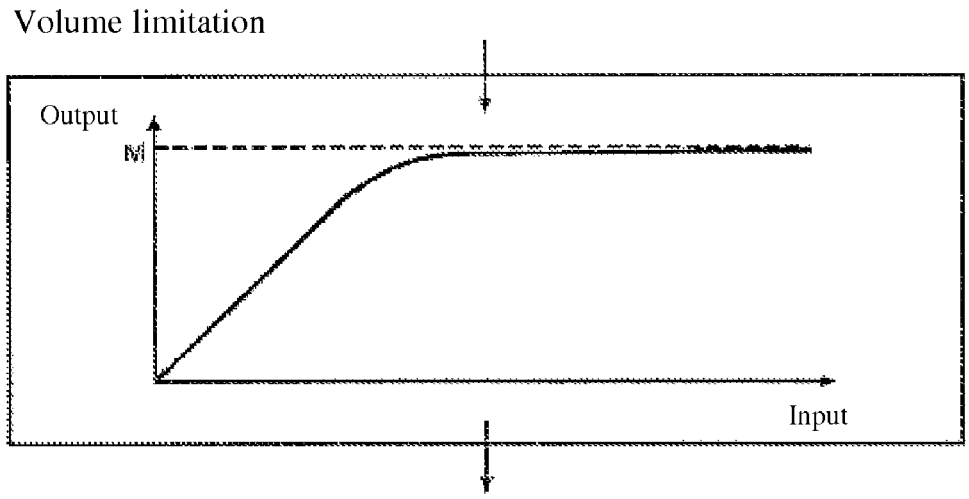
Figure 7:
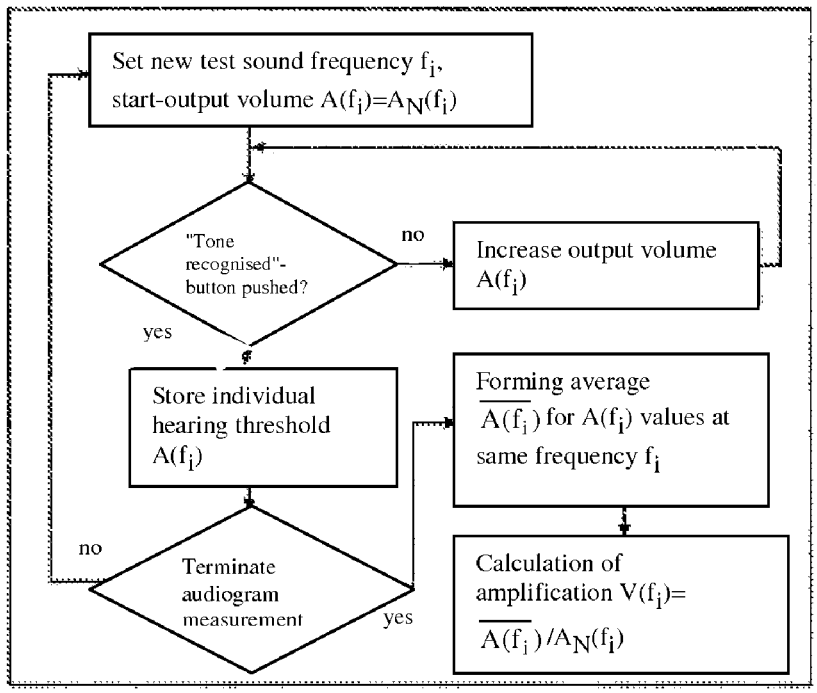
Figure 8:
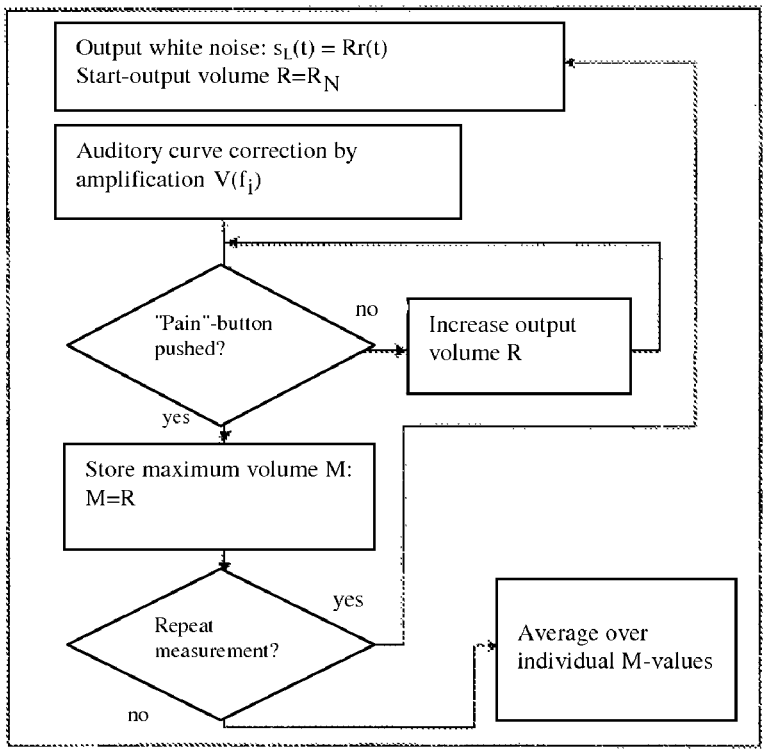
Figure 9:
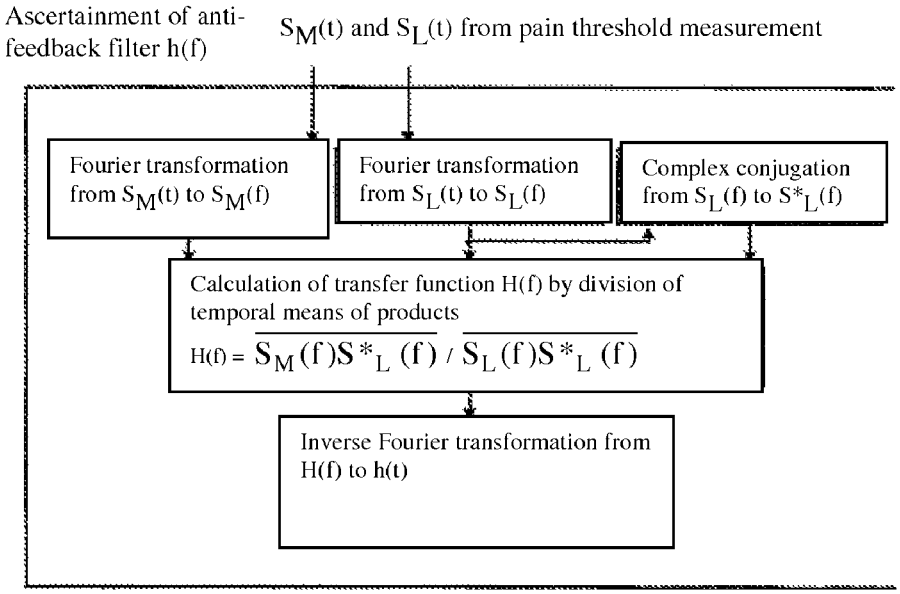

The mode of operation of the hearing aid and the corresponding method are described in the following by means of preferred embodiments with reference to the Figures. They show:

FIG. 1 a schematic representation of the components of a hearing aid according to the invention;

FIG. 2 a schematic representation of a hearing module of a hearing aid according to FIG. 1;

FIG. 3 a schematic representation of an initialising module of a hearing aid according to FIG. 1;

FIG. 4 a schematic representation of an auditory curve correction in a hearing module according to FIG. 2;

FIG. 5*a* a schematic representation of a first embodiment of a noise suppression in a hearing module according to FIG. 2;

FIG. 5*b* a schematic representation of a second embodiment of a noise suppression in a hearing module according to FIG. 2;

FIG. 6 a schematic representation of a volume limitation in a hearing module according to FIG. 2;

FIG. 7 a flow diagram for ascertaining an audiogram according to the invention;

FIG. 8 a flow diagram for ascertaining a maximally acceptable volume according to the invention; and FIG. 9 a schematic representation of the determination of the anti-feedback filter according to the invention.

In a schematic representation, FIG. 1 shows a hearing aid according to the invention, which is at or in the human ear, and which comprises its components, microphone 1, initialising module 2, hearing module 3 and loudspeaker 4, wherein the initialising module 2 is connected to a control device 5 via which the user interacts with the device during initialising. In a preferred embodiment, the hearing aid further comprises an analogue-digital converter 6 and a digital-analogue converter 7 as shown in FIG. 1. As feedback path the acoustic feedback path is depicted via which sound gets from the loudspeaker 4 back into the microphone 1 and may lead to acoustic feedback howling.

It is pointed out that the initialising module 2 and the control device 5 are optional features of the hearing aid according to the invention.

The hearing module 3 comprises a means for noise suppression conducting a noise estimation for determining the parameters of a filter depending on a signal.

An initialising is carried out to optionally adjust the hearing module 3 of the hearing aid to the individual defective hearing of a user—i.e., the deviation from the normal auditory curve—by a correspondingly amplified loudspeaker output of the sound recorded by the microphone 1. To this end an interaction between user and hearing aid is provided according to an embodiment, which takes place through operating elements at the hearing aid itself or a wireless or wired connection to an operation auxiliary means, e.g., a personal computer; this operation auxiliary means is generally described as control device 5 in the following. The control device at least comprises an actuating device comprising a switch and/or a push-button.

The signal flow in the hearing aid is as follows: The microphone signal $s_M(t)$ is preferably discretized and digitised by an analogue-digital converter 6 and supplied to the hearing module 3 and the initialising module 2 where the signal processing, preferably a digital signal processing, takes place. Subsequently, in case of a digital signal processing, a digital-analogue converter 7 generates an output signal $s_L(t)$ with which the ear of the user is treated with sound through a loudspeaker 4.

FIG. 2 shows the hearing module 3 with a summing unit 31, which adds a negative pseudo feedback calculated by the anti-feedback filter 32 to the microphone signal, an optional auditory curve correction 33 by signal amplification dependent on frequency, a sound suppression 34 and a volume limitation 35 of the loudspeaker signal to be outputted. The calculation of the negative pseudo feedback is performed by discrete convolution of the impulse response of the feedback path with the loudspeaker signal to be outputted $s_L(t)$.

In the following the components and the function of the hearing module 3 shown in FIG. 2 are explained in further detail with reference to FIGS. 4 to 6.

The hearing module 3 receives the digital microphone signal $s_M(t)$ and adds the negative pseudo feedback $s_F(t)$ which is calculated by means of the impulse response of the feedback path h(t) as discrete convolution with the loudspeaker signal $S_L(t)$ to $s_F(t)=h(t)*s_L(t)$ to remove the feedback of the loudspeaker signal in the microphone 1 from the microphone signal and to thus prevent a feedback howling. Subsequently, the optional auditory curve correction 33, as shown in more detail in FIG. 4, is performed in that a system of different filters with centre frequencies $f_i=f_1 \ldots f_n$ and amplifications $V(f_i)$ is applied on the signal, wherein the quality of the filters is chosen such that the superposition of all filters has a frequency response as constant as possible when all amplifications $V(f_i)$ have the same value, i.e., $V(f_1)=V(f_2)=V(f_3)= \ldots =V(f_n)$. The $V(f_i)$ values have to be adjusted as exactly as possible to the individual hearing defect so that upon use of the hearing aid the auditory curve of the user approaches the curve of a person with average hearing abilities as close as possible.

The optional auditory curve correction in the hearing module 3 is performed by a series of independent filters, preferably IIR filters. The individual adjustment of the $V(f_i)$ values for the correction of the hearing defect is effected by means of the initialising module 2.

After the optional auditory curve correction 33, a first embodiment of a noise suppression 34 as shown in FIG. 5*a* and known, e.g., from DE 199 48 308 A1, takes place. The signal is subjected to a Fourier transformation in order to obtain an estimation of the noise spectrum by, e.g., minimum detection in the spectrum. This noise estimation is used to determine a filter depending on the noise and signal or the filter coefficients of a filter, which is applied to the signal spectrum. The latter is then re-transformed into a noise-reduced time signal by inverse Fourier transformation, which is provided at the output of the noise suppression 34.

Instead of by means of IIR filters the optional auditory curve correction can be alternatively also realised as filter in the spectrum, as will be shown in the following with reference to a second embodiment according to FIG. 5*b*. To this end the signal is first of all subjected to a Fourier transformation so that the correction factors K(f) may be used directly as multiplication in the signal spectrum to compensate for a hearing defect on the boundary condition that the frequencies $f_i$ are in the frequency raster of the Fourier transformation.

Preferably the correction factors K(f) correspond to the amplification values $V(f_i)$. This embodiment can be advantageously combined with the application of a noise suppression. To this end the signal spectrum is additionally multiplied with damping factors (gain factors) G(f) dependent on signal and noise. The damping factors are preferably determined from a noise estimation R(f) and the current signal spectrum S(f), e.g., as $G(f)=1-R(f)/S(f)$. The noise estimation is formed from the signal spectrum by being averaged over those time intervals where the signal basically only consists of background noise and there is no or only insignificant wanted signal proportion (language). For example, a good noise estimation can be performed in a speech pause where no wanted signal proportion is present. FIG. 5*b* shows the combined application of auditory curve correction by means of correction factors K(f) and noise suppression by means of damping factors G(f). According to FIG. 5*b*, the signal spectrum S(f) is used both for determining a noise estimation R(f) and a multiplication in the spectrum with correction factors K(f). After determination of the noise estimation R(f), the damping factors G(f) are determined, which are based on the noise estimation R(f). After multiplication of the microphone signal in the spectrum with the correction factors K(f) to compensate for the hearing defect, a multiplication in the spectrum with damping factors G(f) is carried out according to FIG. 5*b*. Thus, the signal can be adjusted to, e.g., outer circumstances such as subway, apartment, concert hall, etc. After the corresponding calculations in the spectrum, the signal spectrum thus modified is re-transformed by means of inverse Fourier transformation in a time signal being corrected according to the auditory curve and being noise-reduced, which is provided at the output of the filter module 34.

It is pointed out that the auditory curve correction is optional and the corresponding device feature and the method step may be omitted.

The signal processing as shown in FIG. 5*b* can be modified. For example, the order of the multiplication in the spectrum with correction factors K(f) and the multiplication in the spectrum with damping factors G(f) can be exchanged. According to a further alternative, the multiplication in the spectrum with correction factors K(f) and the multiplication in the spectrum with damping factors G(f) can be combined and preferably effected in one step per frequency band or discrete frequency. To this end, preferably the damping factors G(f) are multiplied with the correction factors K(f) and only afterwards the signal spectrum S(f) is multiplied with the result of this multiplication of the two factors. This is advantageous in that the real time signal (microphone signal) has to undergo only one multiplication, i.e., the signal processing time can be shortened altogether.

The damping factors G(f) are determined based on the noise estimation R(f) which is renewed preferably at certain intervals and/or adaptively in order to be able to account for a change in the noise surroundings. Adaptively means a continuous automatic noise estimation. Besides fixed time intervals dynamic factors can be also used triggering a new noise estimation. A dynamic trigger factor can be a manual user input. A user preferably chooses a moment where there is as little wanted signal as possible. Further, the user may preselect the surroundings with a subsequent optimisation of the noise estimation. Fixed time intervals to determine a new noise estimation can be combined with dynamic trigger factors.

The damping factors can be also applied only in part or not at all, i.e., changed. Here the formula indicated in FIG. 5*b* can be modified to $G(f)=1-c*R(f)/S(f)$, wherein $0<c<1$. Thus, the extent of the noise suppression can be adjusted automatically or manually by the user. At $c=0$, the noise suppression is deactivated and at $c=1$, the noise suppression is completely active. The noise suppression being adjustable, the signal outputted by the loudspeaker (4) can be adjusted as exactly as possible to real acoustic surroundings. For example, a noise suppression could recognise the roar of the ocean or the rustling of leaves as unwanted signal and consequently suppress it although this is not what the user wants in this case.

The last step of the signal processing in the hearing module 3 prior to the output of the signal to the digital-analogue converter 7 and the loudspeaker 4 is the limitation of the maximum output volume to a maximum value M in order to not exceed the individual pain threshold of the user. To this end preferably a characteristic curve as shown in FIG. 6 is used, which is linear for subcritical signal volumes and approaches the threshold M when the pain threshold is reached without exceeding it for even higher input levels. The threshold M is preferably ascertained in the initialising module in interaction with the user.

According to the invention the individual adjustment of the parameters of the hearing module 3 is performed for the ideal compensation of the personal hearing deficit of the user by means of the optional initialising module 2. Here the optional control device 5 is used with which the user interacts with the initialising module 2. As is schematically shown in FIG. 3, in the initialising module 2, the auditory curve of the patient is measured by outputting tones or acoustic signals with increasing volume. In particular the initialising module emits electrical signals which are transformed into tones or acoustic signals. Subsequently, the auditory curve is ascertained relative to the auditory curve of a person with average hearing abilities and the corresponding filters are determined for compensation for the individual hearing defect. Furthermore, the pain threshold of the user is measured by outputting noise of increasing volume. Thus, the maximally bearable output volume is ascertained, which is also individual for each user. Preferably at the same time the impulse response of the feedback path is determined—in that the test signals outputted by the loudspeaker 4 are recorded again by the microphone 1—the response being used for the elimination of feedback in the anti-feedback filter 32 of the hearing module 3.

In the initialising mode according to an embodiment of the invention, the initialising module 2 outputs a series of electrical signals to the loudspeaker 4 which are transformed into acoustic signals, wherein the acoustic signals are used for measuring the auditory curve of the user. The acoustic signals have a certain frequency or a certain frequency spectrum with a certain centre frequency to determine a lower auditory threshold level of the user depending on the respective frequency. In a preferred embodiment, the transmission from microphone 1 to loudspeaker 4 is interrupted while the initialising module 2 is operated to measure the auditory curve of the user.

Preferably, the hearing aid according to the invention further comprises a comparator for comparing a lower auditory threshold level of a user at a certain centre frequency with a stored lower auditory threshold level of a user with normal hearing ability and an adjustment means for adjusting an amplification at the respective frequency in order to compensate a hearing defect of the user.

In order to determine a pain threshold of the user, i.e., a maximally acceptable volume, which is outputted to the loudspeaker 4, the initialising module 2 emits electrical signals, preferably according to a predetermined program, which is explained in more detail with reference to FIG. 8. The hearing module 3 limits the loudspeaker output according to the maximally acceptable volume.

FIG. 7 shows a flow diagram of an audiogram measurement and determination of the amplifications $V(f_i)$ for the auditory curve correction according to an embodiment of the invention. In order to determine the auditory curve of the user and the amplification parameter $V(f_i)$ for the correction of the auditory curve in a first step S1 various test tones are emitted whose frequencies correspond to the centre frequencies $f_i$ of the filters, which are available for the correction of the auditory curve. For a chosen frequency $f_i$, the volume is at first set at $A=A_N$, which preferably corresponds to the volume which is just still audible by a person with average hearing ability, i.e., a lower auditory threshold. In step S2 the volume A is then successively increased at an increase rate to be determined until the user signalises in step S3-yes via pushing a button at the control device 5 that he/she has heard the tone. The corresponding individual lower auditory threshold $A(f_i)$ is stored in step S4. Subsequently, the procedure is repeated in step S5-no with another frequency $f_i$ until the auditory curve measurement is terminated by a corresponding user interaction at the control device 5 and/or a termination condition in step S5-yes is terminated. The individual auditory threshold is determined at least once for all frequencies $f_1, f_2, f_3, \ldots, f_n$, preferably, however, several times to obtain a certain statistical confidence level for the measurement values. Thus, a possible termination condition can be, e.g., a sufficient, ascertained data amount, i.e., all lower auditory thresholds of the user at the respective frequency are at least once ascertained. Subsequently, in step S6 an average value of the various values of $A(f_i)$, i.e., amplification values at the same frequency, is obtained, preferably the median since in this average "freak values"—i.e., completely faulty measurement values—are not contained in the average. In step S7 the amplifications $V(f_i)$ are calculated therefrom.

The number of test tones or acoustic signals of the series of electrical signals for measuring the auditory curve of the user is preferably between 4 and 128 or between 8 and 64 or between 16 and 48 and particularly preferably 32 different tones, i.e., frequencies $f_1$ to $f_{32}$ are measured with the particularly preferred number of tones 32. The amplitude of a tone becoming louder during measurement of the auditory curve of the user is, from a minimum volume to a maximum volume, preferably divided into 10 to 200 or 50 to 150 and particularly preferably into 100 amplitude values, i.e., that the amplitude of a tone becoming louder changes in the particularly preferred stage 100 times from the minimum to the maximum volume.

In a preferred embodiment the frequencies of the successive test tones or acoustic signals are changed during the measurement in a random order or defined pseudo random order.

Besides the optional correction of the personal auditory curve, a further element of the digital signal processing of the hearing aid is the limitation of the maximum output volume which is also individually adjusted to the hearing of the user. FIG. 8 shows a flow diagram of a determination of the maximum volume M according to the invention. To this end, in step S10 noise Rr(t), preferably white noise, is generated with an initial volume $R=R_N$, corresponding to a volume which is approximately in the middle between the hearing threshold and the pain threshold of a person with average hearing ability. Before the noise signal reaches the ear of the user, it is amplified in a frequency-depending manner in step S11 by the auditory curve correction ascertained before-hand by means of the correspondingly adjusted filter $V(f_i)$. This step is preferred so that the measurement of the pain threshold is already adjusted to the personal hearing ability of the user. The volume R of the noise signal is successively increased in step S12 until the user signalises in step S13-yes via pushing a button at the control device that a volume is reached which is considered to be painful. If this is the case, the current value of R is stored as maximum volume M in step 14. This measurement, too, is preferably repeated several times (step S15-yes) in order to be able to obtain an average value of the various measurements in step S16 thus creating a certain statistical confidence level. Preferably the median is ascertained for the average.

The white noise preferably used for ascertaining the maximum volume is preferably outputted in a frequency band of 0-8 kHz from the initialising module 2 via the loudspeaker 4. The sampling rate used for ascertaining the feedback signal via the microphone 1 is higher than 16 kHz according to the Nyquist-Shannon sampling theorem.

The sampling rate of the use of the hearing aid after the initialising is preferably 16 kHz, i.e., a hearing deficit of a user is corrected in a frequency band of preferably 0 kHz to approximately 8 kHz.

Since the white noise is one of the most disagreeable sounds for the human hearing, it is to be assumed that all other sounds which are outputted with the ascertained maximum volume M are less critical. There is a further advantage by the use of (white) noise: the signal is very suitable for the determination of the impulse response of the feedback path h(t) which is used in the anti-feedback filter 32. To this end the microphone signal $s_M(t)$ is analysed, preferably while the outputted loudspeaker signal $S_L(t)$ consists, as described, of noise signals of various volumes to determine the maximum volume M. It is described, e.g., in detail in DE 101 40 523 or DE 100 43 064 how the impulse response h(t) of the acoustic path between loudspeaker 4 and microphone 1—i.e., the feedback path—can be deduced from the simultaneous analysis of microphone and loudspeaker signal.

FIG. 9 shows the determination of the anti-feedback filter 32 and the filter coefficients. Of both signals $s_M(t)$ and $s_L(t)$ spectra $S_M(f)$ and $S_L(f)$ are formed on frames with a predetermined length by means of Fourier transformation; furthermore, the complex conjugate $S^*_L(f)$ is determined of $S_L(f)$.

The product $S_M(f)S^*_L(f)$ as well as the square of the absolute value $S_L(f)S^*_L(f)$ are respectively chronologically averaged and divided. Thus, the transfer function H(f) of the feedback path is obtained from which the impulse response h(t) results by inverse Fourier transformation.

After all desired individual parameters have been determined in the described manner, a change is performed from the initialising module 2 to the hearing module 3 and the wheel turns full circle: the impulse response h(t) last determined is required first of all in the digital signal processing of the hearing module 3. The control device 5 is not required by the hearing module 3 according to the invention after the initialising, however, it can be used for trivial interactions not described in further detail in this context, e.g., for the user-operated volume change or a situation-depending equalizer choice.

This invention has been described by means of examples. It has to be pointed out in this context that individual features, examples and embodiments can be optionally combined and thus further preferred features, examples and embodiments can be achieved.

The invention claimed is:

1. Hearing aid for arrangement at and/or in an ear and connectable to a control device, comprising:

a microphone for converting acoustic signals into electrical signals, a hearing module for processing the electrical signals, a loudspeaker for converting the electrical signals outputted by the hearing module into acoustic signals, wherein the hearing module comprises means for noise suppression conducting a noise estimation to determine parameters of a signal-dependent adjustable filter and to provide a noise-reduced output signal, wherein the means of the hearing module is suitable to ascertain damping factors for the noise suppression based on the noise estimation in order to consider a change in the noise surroundings and wherein the damping factors for the noise suppression can be additionally modified with a factor adjustable by a user in order to vary the extent of the noise suppression.

2. The hearing aid according to claim 1, wherein the means of the hearing module is suitable to multiply the signal from the microphone in the spectrum with correction factors to compensate for a hearing defect and/or with damping factors of the noise suppression in at least one step per frequency.

3. The hearing aid according to claim 1, wherein a noise estimation is carried out at fixed time intervals and/or continuously automatically.

4. The hearing aid according to claim 1, wherein the hearing module comprises a means for compensating a hearing defect by means of correction factors.

5. The hearing aid according to claim 1, further comprising an initialising module for outputting initialising signals to the loudspeaker and a control device via which a user can interact with the hearing aid in order to individually adjust parameters of the hearing module.

6. The hearing aid according to claim 5, wherein the initialising module outputs a series of electrical signals to the loudspeaker which are converted into acoustic signals used for the measurement of the auditory curve of a user, wherein the series of electrical signals preferably correspond to acoustic signals of a certain frequency or a frequency spectrum with a certain centre frequency to interactively determine a lower auditory threshold of the user depending on the respective frequency.

7. The hearing aid according to claim 6 wherein the hearing module compensates the loudspeaker output in accordance with the deviation of the measured auditory curve from a normal auditory curve, and/or wherein the hearing module corn rises various filters with different centre frequencies and respectively adjustable amplification.

8. The hearing aid according to claim 7 comprising a comparator for comparing a lower auditory threshold of a user at a certain centre frequency with a stored lower auditory threshold of a person with normal hearing ability and an adjustment means for adjusting an amplification at the respective frequency.

9. The hearing aid according to claim 7, wherein the electrical signals for determining a pain threshold of the user comprise white noise, wherein preferably the noise signal is amplified depending on the frequency according to the deviation of the ascertained auditory curve from a normal auditory curve.

10. The hearing aid according to claim 6, wherein in an initialising mode electrical signals are outputted from the initialising module to the loudspeaker according to a predetermined program, and wherein preferably the control device comprises a push-button operated by a user as soon as the lower auditory threshold at a centre frequency is reached.

11. The hearing aid according to claim 5, wherein the initialising module outputs electrical signals to the loudspeaker which are converted into acoustic signals which are used for determining a pain threshold of the user for a maximally acceptable volume, wherein preferably the hearing module limits the loudspeaker output according to the maximally acceptable volume.

12. The hearing aid according to claim 1, comprising an anti-feedback filter for calculating a negative pseudo-feedback and a summing unit for adding the negative pseudo-feedback to the microphone signal.

13. The hearing aid according to claim 12, wherein the calculation of the negative pseudo-feedback is effected by discrete convolution of the impulse response of the feedback path with the loudspeaker signal to be outputted, wherein preferably the impulse response of the feedback path in an initialisation of the hearing aid is determined by evaluating the microphone signal during the output of loudspeaker signals, preferably of noise signals and particularly preferably of white noise.

14. A method for noise suppression in a hearing aid, comprising the following steps:

converting acoustic signals into electrical signals with a microphone;

processing the electric signals in a hearing module;

converting the electrical signals outputted by the hearing module into acoustic signals with a loudspeaker, wherein the processing of the electrical signals in the hearing module comprises at least carrying out a noise estimation to determine parameters of a signal-dependent adjustable filter and providing a noise-reduced output signal, ascertaining damping factors for the noise suppression based on the noise estimation in order to consider a change in the noise surroundings and modifying the damping factors for the noise suppression with a factor adjustable by a user in order to vary the extent of the noise suppression.

15. The method according to claim 14, comprising multiplication of the signal from the microphone, in the spectrum with correction factors to compensate for a hearing defect and/or with damping factors of the noise suppression in at least one step per frequency by the hearing module.

16. The method according to claim 14, comprising effecting a noise estimation at fixed time intervals and/or automatically continuously.

17. The method according to claim 14, wherein the processing of electrical signals further comprises compensation of a hearing defect with correction factors.

18. The method according to claim 14, comprising outputting of initialising signals to the loudspeaker via an initialising module in order to individually adjust parameters of the hearing module, preferably by the user's interaction with the hearing aid by means of a control device.

19. The method according to claim 18, comprising outputting a series of electrical signals from the initialising module to the loudspeaker, which electrical signals are converted into acoustic signals used to measure the auditory curve of a user, wherein the series of electrical signals preferably correspond to acoustic signals of a certain frequency or a frequency spectrum with a certain centre frequency to interactively determine a lower auditory threshold of the user depending on the respective frequency.

20. The method according to claim 14, comprising calculating a negative pseudo-feedback by means of an anti-feedback filter and adding the negative pseudo-feedback to the microphone signal by means of a summing unit and calculating the negative pseudo-feedback by discrete convolution of the impulse response of the feedback path with the loudspeaker signal to be outputted, wherein preferably the impulse response of the feedback path in an initialisation of the hearing aid is determined by evaluating the microphone signal during the output of loudspeaker signals, preferably of noise signals and particularly preferably of white noise.

* * * * *

UNITED STATES PATENT AND TRADEMARK OFFICE

CERTIFICATE OF CORRECTION

PATENT NO. : 8,406,441 B2
APPLICATION NO. : 12/669249
DATED : March 26, 2013
INVENTOR(S) : Dietmar Ruwisch It is certified that error appears in the above-identified patent and that said Letters Patent is hereby corrected as shown below:

In the Claims

Column 10, claim 7, line 3, “corn rises” should be replaced with “comprises.”

Signed and Sealed this
Fourth Day of February, 2014

Michelle K. Lee

Michelle K. Lee
*Deputy Director of the United States Patent and Trademark Office*